US012116911B2

(12) United States Patent
Zhu et al.

(10) Patent No.: US 12,116,911 B2
(45) Date of Patent: Oct. 15, 2024

(54) ROCKER ARM MECHANISM OF ENGINE, SYSTEM AND METHOD FOR TWO-STROKE ENGINE BRAKE

(71) Applicant: SHANGHAI UNIVERSOON AUTOTECH CO., LTD., Shanghai (CN)

(72) Inventors: Rujie Zhu, Shanghai (CN); Baoliang Xing, Shanghai (CN); Zheng Xi, Shanghai (CN); Zhou Yang, Shanghai (CN)

(73) Assignee: SHANGHAI UNIVERSOON AUTOTECH CO., LTD., Shanghai (CN)

( * ) Notice: Subject to any disclaimer, the term of this patent is extended or adjusted under 35 U.S.C. 154(b) by 0 days.

(21) Appl. No.: 18/546,056

(22) PCT Filed: Jan. 26, 2022

(86) PCT No.: PCT/CN2022/074127

§ 371 (c)(1),
(2) Date: Aug. 10, 2023

(87) PCT Pub. No.: WO2022/170981

PCT Pub. Date: Aug. 18, 2022

(65) Prior Publication Data

US 2024/0125256 A1 Apr. 18, 2024

(30) Foreign Application Priority Data

Feb. 10, 2021 (CN) ..... 202110184061.8
Mar. 4, 2021 (CN) ..... 202110239999.5

(51) Int. Cl.
*F01L 13/06* (2006.01)
*F01L 1/18* (2006.01)
(Continued)

(52) U.S. Cl.
CPC ..... *F01L 13/06* (2013.01); *F01L 1/18* (2013.01); *F01L 1/20* (2013.01)

(58) Field of Classification Search
CPC ..... F01L 13/06; F01L 13/066; F01L 1/18
(Continued)

(56) References Cited

U.S. PATENT DOCUMENTS 3,220,392 A 11/1965 Cummins
4,572,114 A 2/1986 Sickler
(Continued)

FOREIGN PATENT DOCUMENTS

CN 101029582 A 9/2007
CN 202194698 U 4/2012
(Continued)

*Primary Examiner* — Phutthiwat Wongwian
*Assistant Examiner* — Arnold Castro
(74) *Attorney, Agent, or Firm* — NKL Law; Allen Xue

(57) ABSTRACT

A rocker arm mechanism of an engine, a system and a method for two-stroke engine brake are provided. The rocker arm mechanism includes a first rocker arm, a second rocker arm and a connection mechanism. One end of the first rocker arm and one end of the second rocker arm is rotatably connected to a shaft, the other end of the first rocker arm is close to a valve of the engine, while the other end of the second rocker arm is close to a cam. The connection mechanism includes a connecting piston and a linkage mechanism. The connecting piston is disposed in the first rocker arm or the second rocker arm, the linkage mechanism is rotatably connected to one end of the connecting piston. The rocker arm mechanism may be used for engine cylinder deactivation and engine brake.

16 Claims, 5 Drawing Sheets

(51) Int. Cl.
*F01L 1/20* (2006.01)
*F01L 1/38* (2006.01)

(58) Field of Classification Search
USPC ..... 123/320, 321, 322
See application file for complete search history.

(56) References Cited

U.S. PATENT DOCUMENTS

| | | | | |
|---|---|---|---|---|
| 5,537,976 | A | 7/1996 | Hu | |
| 5,937,807 | A | 8/1999 | Peters et al. | |
| 5,975,251 | A | 11/1999 | McCarthy | |
| 6,293,248 | B1 * | 9/2001 | Zsoldos | F01L 1/181 123/321 |
| 8,936,006 | B2 | 1/2015 | Groth et al. | |
| 2012/0024260 | A1 * | 2/2012 | Groth | F01L 1/18 123/321 |
| 2014/0182528 | A1 | 7/2014 | Jeon et al. | |
| 2014/0251266 | A1 * | 9/2014 | Emmons | F02D 13/04 123/321 |
| 2014/0326212 | A1 * | 11/2014 | Baltrucki | F01L 13/06 123/321 |
| 2019/0040802 | A1 * | 2/2019 | Lilly | F01L 13/065 |
| 2021/0156319 | A1 * | 5/2021 | Stec | F01L 1/46 |

FOREIGN PATENT DOCUMENTS

| | | | |
|---|---|---|---|
| CN | 107023342 | A | 8/2017 |
| CN | 106509958 | B | 7/2018 |
| CN | 215761837 | U | 2/2022 |
| CN | 114909199 | A | 8/2022 |
| CN | 115013110 | A | 9/2022 |
| DE | 102010010732 | A1 | 9/2011 |

* cited by examiner

ROCKER ARM MECHANISM OF ENGINE, SYSTEM AND METHOD FOR TWO-STROKE ENGINE BRAKE

TECHNICAL FIELD

The present invention relates to the field of machinery, in particular to the field of engine valve actuation, and more particularly to a rocker arm mechanism of an engine, system and method for two-stroke engine brake.

BACKGROUND ART

Conventional valve actuation of vehicle engines is well known in the prior art and has been used for over one hundred years. For conventional valve actuation, conventional valve actuators are used, including rocker arms, to control motion of a valve of an engine for conventional ignition operation of the engine. However, due to additional requirements for engine fuel efficiency, exhaust emissions and engine brake, more and more engines are provided with variable valve actuation, including engine cylinder deactivation with complete elimination of valve motion, and engine brake has also been widely adopted for commercial vehicle engines. A four-stroke engine brake is currently used on the market. In each engine cycle (including four strokes: an intake stroke, a compression stroke, an expansion stroke, and an exhaust stroke), only one compression release brake is performed at the end of the compression stroke (near the compression top dead center). While for the two-stroke engine brake, two compression-release brakes are performed in each engine cycle (four strokes) near the compression top dead center and near the expansion top dead center, respectively. Therefore, theoretically, two-stroke brake should be twice as powerful as four-stroke brake. However, since two-stroke brake requires engine cylinder to be deactivated, i.e. the normal engine or conventional valve lifts need to be canceled, which leads to the technical difficulty and mechanism complexity, as well as high cost, and no two-stroke brake product has ever been made.

One precedent for the four-stroke engine brake is disclosed in U.S. Pat. No. 3,220,392, issued to Cummins, according to which engine brake systems were made with great commercial success. However, such engine brake systems are accessories that are bolt-on the engine. In order to install the engine brake, a gasket is added between the cylinder head and the valve cover, thereby additionally increasing the height, weight and cost of the engine. In addition, the Cummins brake uses hydraulic linkage to drive the valves, with "three high problems" (high load, high leakage and high deformation), as well as high hydraulic pressure and the hydraulic jacking problems.

U.S. Pat. Nos. 5,937,807 and 5,975,251 (1999) disclose another type of four-stroke brake employing a dedicated brake rocker arm mounted alongside an exhaust rocker arm on a rocker shaft, the dedicated brake rocker arm driving only one of the two engine exhaust valves during brake, still with hydraulic linkage.

U.S. Pat. No. 4,572,114 (1986) and 5,537,976 (1996) disclose devices and methods for two-stroke engine brake, including cam actuation, hydraulic connections, high-speed solenoid valves, and electronic controls to achieve variable valve motion for the normal operation (firing) of the engine or the engine brake. Since the solenoid valve needs to be opened at least once every cycle, there is an extremely high requirement in reliability and durability of the solenoid valve. In addition, there are other problems with hydraulic actuation, such as the control of valve seating speed, the cold start of the engine, and the like, the invention has not found practical application.

U.S. Pat. No. 6,293,248 (2001) discloses another device and method for two-stroke engine brake. Four rocker arms are used: the cylinder deactivation exhaust rocker arm, the brake exhaust rocker arm, the cylinder deactivation intake rocker arm and the brake intake rocker arm to drive the valves of the engine. The structure and the control are complicated, and the engine valves are opened by hydraulic actuation.

U.S. Pat. No. 8,936,006 (2015) discloses a device and method for two-stroke engine brake similar to that of the above 2001 U.S. Patent, for which four rocker arms are used: a cylinder deactivation exhaust rocker arm, a brake exhaust rocker arm, a cylinder deactivation intake rocker arm, and a brake intake rocker arm. The cylinder deactivation mechanism is a lost motion mechanism integrated in the valve bridge of the engine. Both the brake exhaust rocker arm and the brake intake rocker arm are hydraulically driven to open one valve (two valves are opened during the normal engine operation). The lift of the brake valve is affected by the tilt of the valve bridge, and reliability and durability are big problems.

SUMMARY OF THE INVENTION

It is an object of the present invention to provide a rocker arm mechanism of an engine, a system and method for two-stroke engine brake that solve the problems of the prior art, such as complicated structure and control, poor reliability and durability, hydraulic actuation with "three highs", high cost and the inability to transform into a product.

The present invention provides a rocker arm mechanism for variable valve actuation of an engine, which is characterized by including: a connecting mechanism with a first rocker arm, a second rocker arm and a connection mechanism, wherein one end of the first rocker arm and one end of the second rocker arm is rotatably connected to a shaft, the other end of the first rocker arm is close to a valve of the engine, the other end of the second rocker arm is close to a cam, the connection mechanism includes a connecting piston and a linkage mechanism, the connecting piston is disposed at the first rocker arm or the second rocker arm, the linkage mechanism is rotatably connected to one end of the connecting piston, the other end of the connecting piston is close to the first rocker arm or the second rocker arm in which the connecting piston is not disposed, extension and contraction of the linkage mechanism change a distance between the connecting piston and the first rocker arm or the second rocker arm in which the connecting piston is not disposed, and the motion transferred to the engine valve from the cam is changed.

Further, the present invention further includes an anti no-follow spring urging the first rocker arm toward the engine valve and urging the second rocker arm toward the cam.

Further, the linkage mechanism includes a first linkage and a second linkage, one end of the first linkage is rotatably connected to one end of the second linkage, the other end of the first linkage is rotatably connected to the connecting piston, the other end of the second linkage is rotatably connected to the first rocker arm or the second rocker arm, an angle between the first linkage and the second linkage is greater than 0° to less than or equal to 180°, when the angle is 180°, the first linkage and the second linkage are on an axis of the connecting piston, and the linkage mechanism fully extends with a maximum length in the first rocker arm or the second rocker arm, and the motion of the cam is transferred to the maximum extent to the engine valve, and when the angle decreases, the linkage mechanism contracts with a reduced length in the first rocker arm or the second rocker arm, and motion of the cam transferred to the engine valve decreases.

Further, the connection mechanism includes an driving spring that extends the linkage mechanism.

Further, the connection mechanism includes an actuation piston that retracts the linkage mechanism.

Further, the present invention further includes a stop mechanism limiting the rotation between the first rocker arm and the second rocker arm on the shaft.

Further, the present invention includes a positioning mechanism of a valve bridge of the engine, the positioning mechanism of the valve bridge including a positioning piece fixed to the first rocker arm and connected to the engine valve or the valve bridge.

The present invention also provides an engine brake device including a brake rocker arm and a brake cam. The brake rocker arm is disposed alongside the rocker arm mechanism on a rocker shaft of the engine, the brake rocker arm being in a braking state when the connection mechanism of the rocker arm mechanism is in the retracted state, motion of the brake cam being transferred to an engine valve to generate an engine brake valve motion.

The present invention provides a two-stroke engine brake system including four rocker arms to actuate engine valves, the four rocker arms including a cylinder deactivation exhaust rocker arm, a brake exhaust rocker arm, a conventional intake rocker arm and a brake intake rocker arm. During the two-stroke engine brake, a. Utilizing the cylinder deactivation exhaust rocker arm to cancel the exhaust valve lift that is for the engine normal (firing) operation, the engine exhaust stroke being converted to a second compression stroke for the two-stroke engine brake, the cylinder deactivation exhaust rocker arm including the rocker arm mechanism as described above.

b. Utilizing the brake exhaust rocker arm to generate an exhaust valve lift for the two-stroke engine brake;

c. Utilizing the conventional intake rocker arm to generate the same intake valve lift in the intake stroke of the engine as when the engine is in the normal (firing) operation to supply gas for the first compression stroke of the two-stroke engine brake, and d. Utilizing the brake intake rocker arm to generate a braking intake valve lift in the expansion stroke of the engine to supply gas for the second compression stroke.

Further, the four rocker arms are fixed-chain type mechanisms that transfer cam motion to engine valves through a mechanical (solid) linkage.

Further, the exhaust valve lift for the two-stroke engine brake includes:

a. a first compression-released exhaust valve lift near the compression top dead center of the engine, and b. a second compression-released exhaust valve lift near the exhaust top dead center of the engine.

Further, the exhaust valve lift for the two-stroke engine brake further includes:

a. a first EGR (Exhaust Gas Recirculation) exhaust valve lift near the intake bottom dead center of the engine, and b. a second EGR exhaust valve lift near the expansion bottom dead center of the engine.

Further, the angle degrees between the starting point of the second compression-released exhaust valve lift and the exhaust top dead center of the engine are greater than the angle degrees between the starting point of the first compression-released exhaust valve lift and the compression top dead center of the engine.

Further, the exhaust valve lifts of the first compression release, the second compression release, the first EGR, and the second EGR of the two-stroke engine brake are from different lobes on the same cam, which may be separated or end-to-end, and have a height that is less than the conventional exhaust lobe of the engine.

Further, the two-stroke engine brake exhaust valve lift is from one of the two exhaust valves of the engine.

Further, the brake intake valve lift starts after the compression top dead center of the engine and closes near the expansion bottom dead center of the engine with a lift less than the conventional intake valve lift for the engine firing operation.

Further, the brake intake valve lift is generated by the brake intake rocker arm actuating on the conventional intake rocker arm opening the two intake valves of the engine.

The present invention provides a method for two-stroke engine brake, wherein four rocker arms are used to drive the valves of an engine, including a cylinder deactivation exhaust rocker arm, a brake exhaust rocker arm, a conventional intake rocker arm and a brake intake rocker arm, during the two-stroke engine brake, a. utilizing the cylinder deactivation exhaust rocker arm to cancel the exhaust valve lift that is for the engine normal (firing) operation, the engine exhaust stroke being converted to a second compression stroke for the two-stroke engine brake, said cylinder deactivation exhaust rocker arm comprising the rocker arm mechanism according to any one of claims 1-7;

b. Utilizing the brake exhaust rocker arm to generate an exhaust valve lift for the two-stroke engine brake;

c. Utilizing the conventional intake rocker arm to generate the same intake valve lift in the intake stroke of the engine as when the engine is in the normal (firing) operation to supply gas for the first compression stroke of the two-stroke engine brake, and d. Utilizing the brake intake rocker arm to generate a braking intake valve lift in the expansion stroke of the engine to supply gas for the second compression stroke.

Further, the four rocker arms are fixed-chain type mechanisms that transfer motion of a cam to the valves of the engine through a mechanical linkage.

Further, the two-stroke engine brake exhaust valve lift includes:

a. a first compression-released exhaust valve lift near the compression top dead center of the engine, and b. a second compression-released exhaust valve lift near the exhaust top dead center of the engine.

Further, the two-stroke engine brake exhaust valve lift further includes:

a. a first EGR exhaust valve lift near the intake bottom dead center of the engine, and b. a second EGR exhaust valve lift near the expansion bottom dead center of the engine.

Further, the angle degrees between the starting point of the second compression-released exhaust valve lift and the exhaust top dead center of the engine are greater than the angle degrees between the starting point of the first compression-released exhaust valve lift and the compression top dead center of the engine.

Further, the exhaust valve lifts of the first compression-released, the second compression-released, the first EGR or the second EGR of the two-stroke engine brake are from different lobes on the same cam, which may be separated or end-to-end, having a lift that is less than the lift of the exhaust lobe for the engine firing operation.

Further, the two-stroke brake exhaust valve lift of the engine comes from one of the two exhaust valves of the engine.

Further, the engine-brake intake valve lift starts after the compression top dead center of the engine and closes near the expansion bottom dead center of the engine with a lift less than the intake valve lift for the engine firing operation.

Further, the engine-brake intake valve lift is generated by the brake intake rocker arm actuating on the conventional intake rocker arm opening the two intake valves of the engine.

The effect of the present invention is positive and obvious compared to the prior art. The rocker arm mechanism of the present invention is composed of a first rocker arm and a second rocker arm which are connected or separated through the expansion and contraction of a linkage mechanism to generate or lose motion of the engine valve(s) to achieve the conversion between the normal (firing) operation of the engine and engine cylinder deactivation or engine brake, etc. and has advantages such as simple and reliable structure, easy manufacturing and assembly and wide application; in particular, the linkage mechanism has a large amount of lift and contraction (i.e., a large range of angle variation between the first linkage and the second linkage), and can be applied to variable valve actuation of the engine with a large lift, including canceling the full valve lift (engine cylinder deactivation) and creating a large stroke engine brake.

For the system and method for the two-stroke engine brake of the present invention, a fixed-chain type rocker arm that transfers load through a solid state connection (mechanical linkage) is used, particularly for preserving the conventional intake rocker arm and the conventional intake valve lift, having the advantages of simple and reliable construction, ease of manufacture and assembly, reduced cost, and broad applicability.

DETAILED DESCRIPTION OF THE INVENTION

Embodiment I

Figure 1:
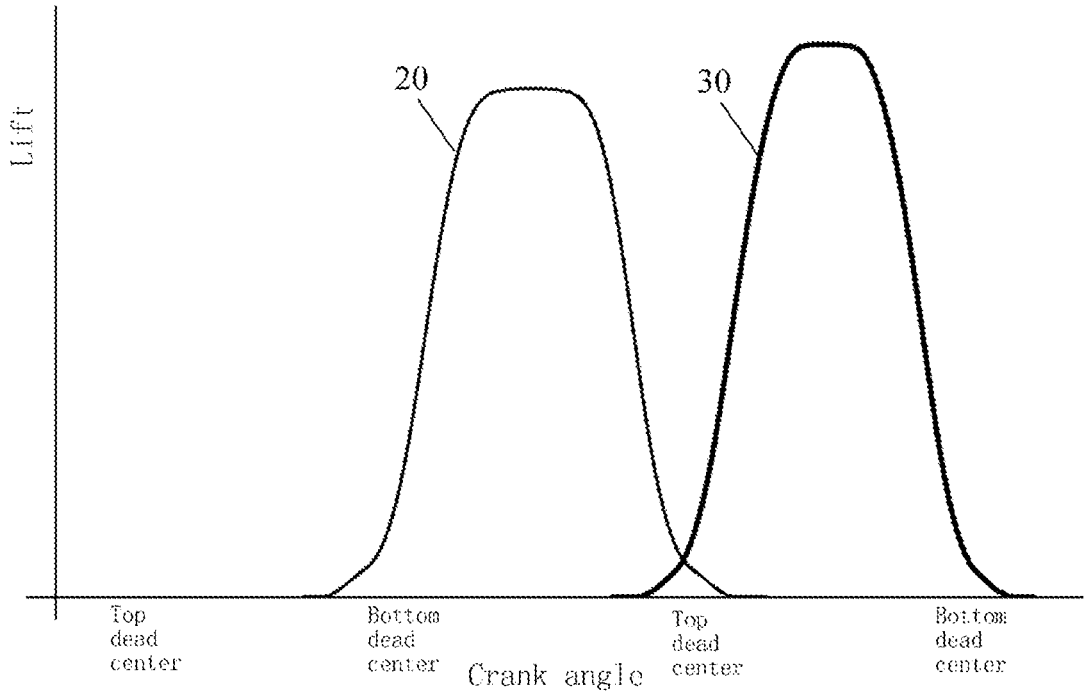
FIG. 1 is a schematic diagram of the intake and exhaust valve lift at normal (firing) operation of the engine.

FIG. 1 is a schematic diagram of the intake and exhaust valve lifts for the firing operation of the engine in the prior art, which is common knowledge. The exhaust cam drives the exhaust rocker arm to open one or two exhaust valves in the exhaust stroke of the engine to release the combusted exhaust gases. The exhaust valve lift 20 (thin solid line in FIG. 1) starts before the expansion bottom dead center and closes after the exhaust top dead center of the engine. The intake cam drives the intake rocker arm to open one or two intake valves in the intake stroke of the engine to let in fresh air.

The intake valve lift 30 (thick solid line in FIG. 1) starts before the exhaust top dead center and closes after the intake bottom dead center of the engine. It is particularly worth noting that the major function of the engine is to generate positive power by the firing operation. Whether it is the four-stroke engine brake or the two-stroke engine brake (including the two-stroke engine brake of the present application), the engine must have the intake and exhaust valve lifts 20 and 30 shown in FIG. 1 during the firing operation.

Figure 2:
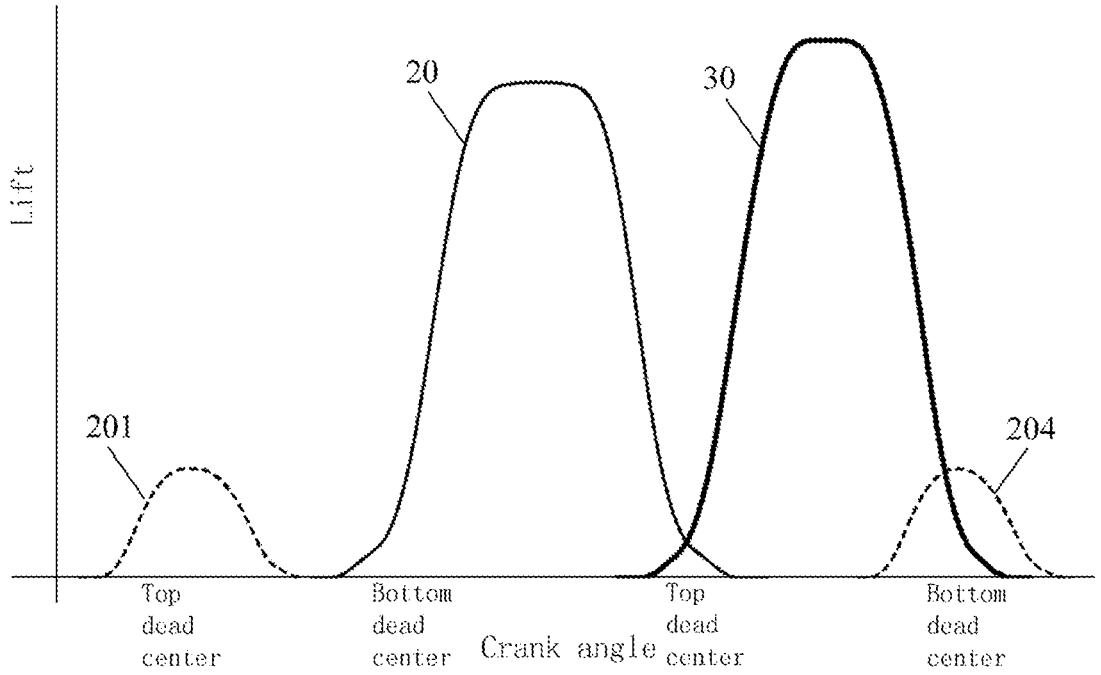
FIG. 2 is a schematic diagram of the intake and exhaust valve lift during the four-stroke engine brake.

FIG. 2 is a schematic diagram of the intake and exhaust valve lift during a four-stroke engine brake in the prior art, which is also well known and can be generated in a number of ways. One of the most widely used way today is to use a dedicated brake cam to drive an engine valve via a dedicated brake rocker arm, creating the brake valve lift. During engine braking, the newly created brake exhaust valve lifts 201 and 204 (thin broken lines in FIG. 2) are added to the exhaust valve lift 20 and the intake valve lift 30 for the firing operation of the engine. The exhaust valve lift 201 is a compression release brake valve motion occurring near the compression top dead center of the engine (starting before the compression top dead center and closing after the compression top dead center) for releasing high pressure gas (air) compressed in the cylinder during the engine compression stroke; the exhaust valve lift 204 is an EGR (Exhaust Gas Recirculation) valve motion that occurs near the engine intake bottom dead center (starting before the intake bottom dead center and closing after the intake bottom dead center) to let the exhaust gas in the exhaust pipe flowing back into the engine cylinder when the intake valve lift is about to approach to zero, which increases the engine brake power.

Figure 3:
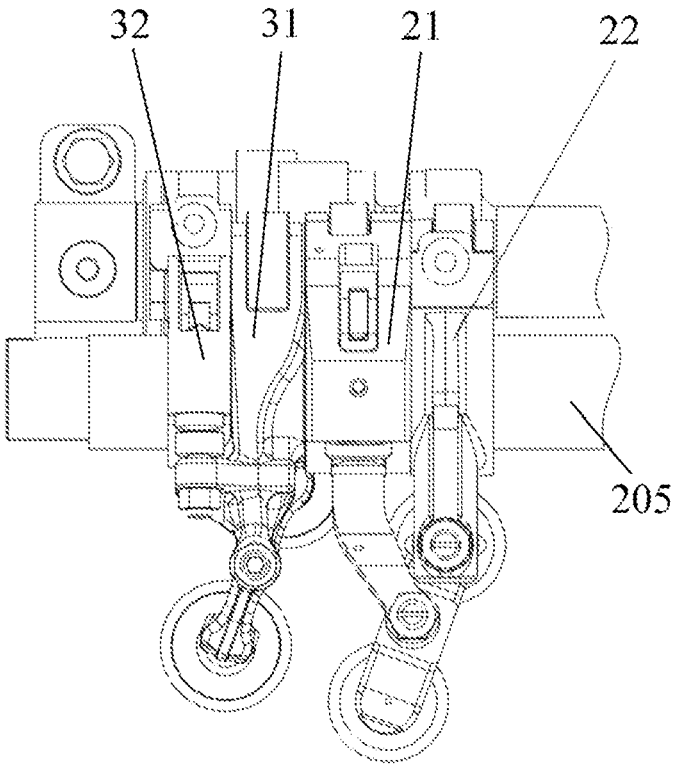
FIG. 3 is a schematic diagram of the four rocker arms for the two-stroke engine brake according to the present invention.
Figure 4:
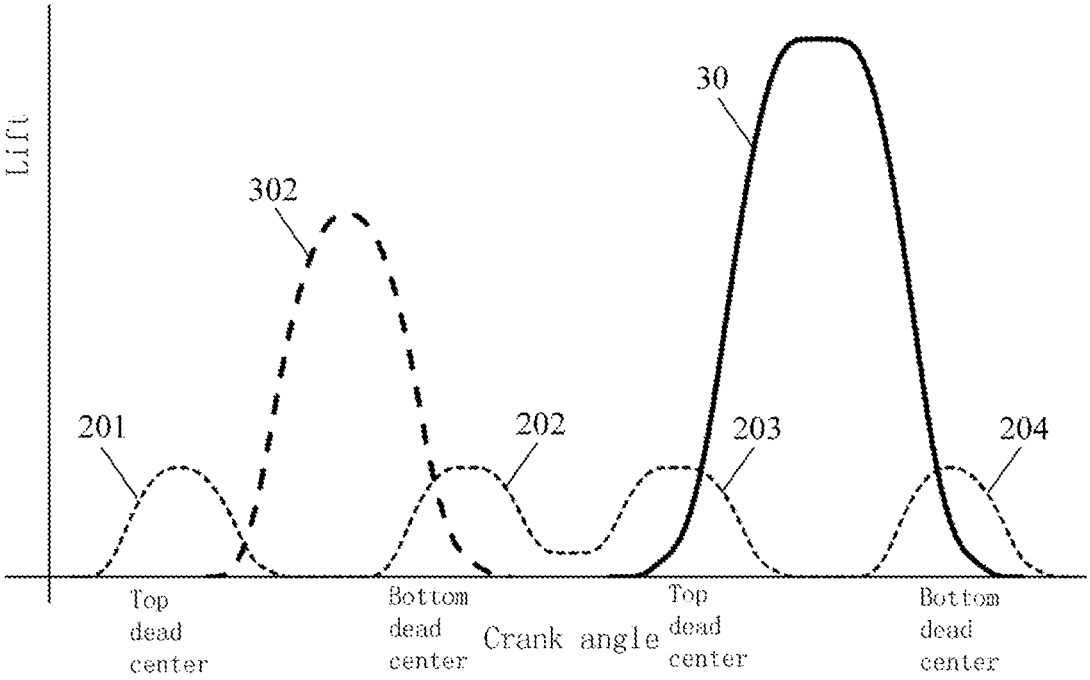
FIG. 4 is a schematic diagram of the intake and exhaust valve lift during the two-stroke engine brake according to the present invention.

FIGS. 3 and 4 are schematic diagrams used to describe the system and method for a two-stroke engine brake according to the present invention. The two-stroke engine brake uses four rocker arms (FIG. 3, the embodiment is a fixed-chain type rocker arm that transfers load through a solid connection (mechanical linkage) rather than a hydraulic linkage) to actuate the engine's exhaust and intake valves), including a cylinder deactivation exhaust rocker arm 21, a brake exhaust rocker arm 22, a conventional intake rocker arm 31, and a brake intake rocker arm 32. The four rocker arms as shown in FIG. 3 are disposed side by side on the same rocker shaft 205, but there could be other arrangements, such as four rocker arms disposed on two different rocker shafts.

The cylinder deactivation exhaust rocker arm 21 of the embodiment of the present application replaces the conventional exhaust rocker arm of the engine; during two-stroke engine brake, the cylinder deactivation mechanism in the cylinder deactivation exhaust rocker arm 21 cancels the engine firing exhaust valve lift 20 (in FIG. 1 but not shown in FIG. 4), and converts the exhaust stroke of the engine into a second compression stroke for the two-stroke engine brake (the original or conventional compression stroke of the engine is the first compression stroke for the two-stroke engine brake).

Figure 5:
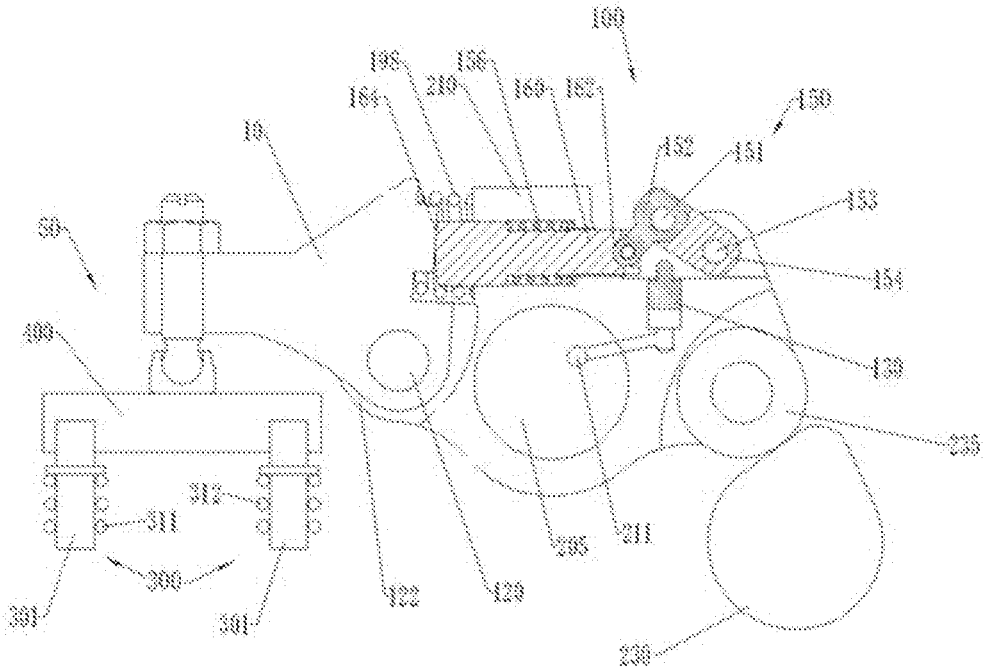
FIG. 5 is a schematic diagram of a specific cylinder deactivation mechanism in a cylinder deactivation exhaust rocker arm, wherein a linkage mechanism is in a retracted state according to the present invention.
Figure 6:
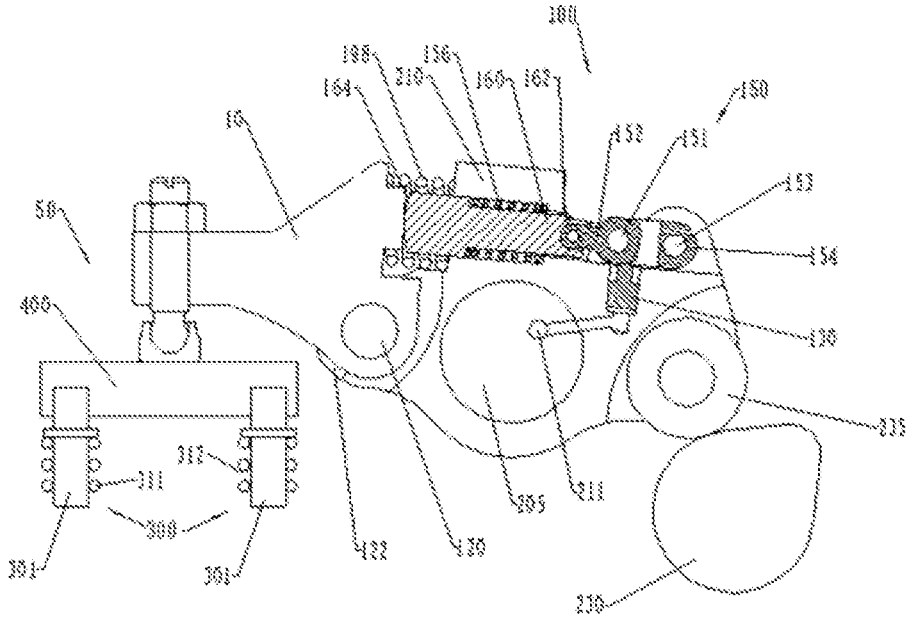
FIG. 6 is a schematic diagram of a specific cylinder deactivation mechanism in a cylinder deactivation exhaust rocker arm, wherein a linkage mechanism is in an extended state according to the present invention.

In this embodiment, the specific configuration of the cylinder deactivation mechanism in the cylinder deactivation exhaust rocker arm 21 may be as follows:

FIGS. 5 and 6 are intended to describe a specific structure of the cylinder deactivation mechanism in the cylinder deactivation exhaust rocker arm 21. There is a first rocker arm 10, a second rocker arm 210 and a connection mechanism 100 (the cylinder deactivation mechanism in the cylinder deactivation exhaust rocker arm 21), wherein one end of the first rocker arm 10 and one end of the second rocker arm 210 are rotatably connected to a shaft 120, the other end of the first rocker arm 10 is close to the engine valves 300, and the other end of the second rocker arm 210 is close to a cam 230 of the engine. The connection mechanism 100 includes a connecting piston 160 and a linkage mechanism 150 which are both disposed on the second rocker arm 210 (the connecting piston 160 can be disposed in a matched piston bore in the second rocker arm 210), one end of the linkage mechanism 150 is rotatably connected to the second rocker arm 210 at 153, the other end of the linkage mechanism 150 is rotatably connected to one end 162 of the connecting piston 160, and the other end 164 of the connecting piston 160 is close to the first rocker arm 10 that does not have the connecting piston 164. The extension and contraction of the linkage mechanism 150 change the length of the connection mechanism 100 between the first rocker arm 10 and the second rocker arm 210 (see the change in length between 153 and 164 in FIGS. 5 and 6), and the motion of the cam 230 transferred to the valves 300 of the engine is changed. Of course, another embodiment could be adopted in which both the connecting piston 160 and the linkage mechanism 150 are disposed in the first rocker arm 10 with the other end 164 of the connecting piston 160 being adjacent to the second rocker arm 210 that does not have the connecting piston but could have a connecting member).

The linkage mechanism 150 includes a first linkage 152 and a second linkage 154, one end of the first linkage 152 and one end of the second linkage 154 are rotatably connected via a pin 151 (which may also be a spherical surface), the other end of the first linkage 152 is rotatably connected to one end 162 of the connecting piston 160, and the other end of the second linkage 154 is rotatably connected to the second rocker arm 210 (when the connecting piston 160 and the linkage mechanism 150 are both disposed in the first rocker arm 10, then the other end of the second linkage 154 is connected to the first rocker arm 10) via a pin 153 (which may also be a spherical surface); an angle between the first linkage 152 and the second linkage 154 is greater than 0° to less than or equal to 180° (see FIGS. 5&6). When the angle is equal to 180°, the first linkage 152 and the second linkage 154 are on the axis of the connecting piston 160 (the motion direction of the piston 160), and at this time, the connecting piston 160 is locked with the linkage mechanism 150 to the second rocker arm 210 (or the first rocker arm 10) and cannot move relative to each other (see FIG. 6); the length (between 153 and 164) of the connection mechanism 100 between the first rocker arm 10 and the second rocker arm 210 is maximized, and the motion of the cam 230 is maximally (fully) transferred to the valves 300 of the engine; when the actuation piston 130 pushes the linkage mechanism 150 such that the angle is reduced (less than 180°), the linkage mechanism 150 retracts to unlock (see FIG. 5) and the length of the connection mechanism 100 between the first rocker arm 10 and the second rocker arm 210 is reduced (the length between 153 and 164 in FIG. 5 is less than the length in FIG. 6), and the motion of the cam 230 transferred to the valves 300 of the engine is reduced or even completely lost (engine cylinder deactivation).

The connection mechanism 100 further includes a driving spring 156, and with its force the linkage mechanism 150 can be fully extended that the first linkage 152 and the second linkage 154 are aligned with the axis of the connecting piston 160. The preload of the driving spring 156 can even unfold the linkage mechanism 150 when the angle between the first linkage 152 and the second linkage 154 is small to generate a larger stroke (of the connecting piston 160).

It is noted that the driving spring 156 can also prevent no-follow. If desired, however, an anti no-follow spring 198 can be added between the first rocker arm 10 and the second rocker arm 210. The anti no-follow spring 198 urges the second rocker arm 210 toward the cam 230 of the engine. The anti no-follow spring may also be mounted at other locations to help the driving spring 156 to reduce the impact between the first and second rocker arms.

This embodiment provides a stop mechanism at 122 between the first rocker arm 10 and the second rocker arm 210 which limits the first rocker arm 10 and the second rocker arm 210 from rotating too far relative to the shaft 120 to facilitate handling and installation.

This embodiment is implemented as follows: when the engine requires cylinder deactivation (eliminating the normal or conventional valve motion of the engine), the cylinder deactivation control valve (not shown) opens to supply engine oil to the actuation piston 130 via oil passages (such as the axial oil hole 211 in the rocker shaft 205), the oil pressure pushes the actuation piston 130 out (upwards in the figure), the linkage mechanism 150 in FIG. 6 which is fully extended to a flat angle is pushed to the retracted position shown in FIG. 5, the length of the connection mechanism 100 between the second rocker arm 210 and the first rocker arm 10 is reduced (the length between 153 and 164 in FIG. 5 is less than the length in FIG. 6), the motion of the cam 230 driving the second rocker arm 210 is absorbed (lost), the motion of the valve 300 is zero, and the engine cylinder is deactivated. During this process, the driving spring is compressed due to the reduced length described above.

When it is needed to restore the normal or conventional valve motion of the engine, the cylinder deactivation control valve (not shown) disconnects and the engine oil is discharged, the actuation piston 130 loses the oil pressure, the driving spring 156 extends from the compressed state, the linkage mechanism 150 is unfolded from a contracted state (the angle between the first linkage 152 and the second linkage 154 is less than a flat angle in FIG. 5) to a straight status (the angle between the first linkage 152 and the second linkage 154 is a flat angle in FIG. 6), and a lock is formed between the connecting piston 160 and the second rocker arm 210 (or the first rocker arm 10) through the linkage mechanism 150; the connection mechanism 100 has a maximum length (a length between 153 and 164) between the first rocker arm 10 and the second rocker arm 210. The motion of the cam 230 is transferred to the engine valve 300 via the roller 235, the second rocker arm 210, the linkage mechanism 150, the connecting piston 160, the first rocker arm 10 (there may also be a connecting member), an e-foot mechanism 50, and a valve bridge 400 (a valve cap, not shown).

It is noted that the above description applies to the actuation of both the exhaust valve and the intake valve of the engine.

Figure 7:
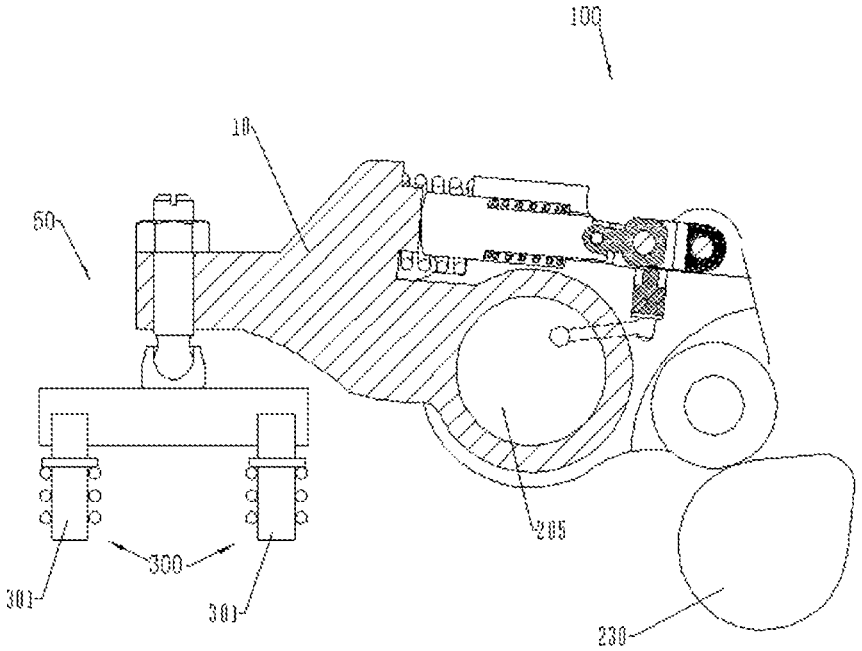
FIG. 7 is a schematic diagram of a specific cylinder deactivation mechanism in a cylinder deactivation exhaust rocker arm, wherein a linkage mechanism is in an extended state, but the first rocker arm has a second way of connection according to the present invention.

At the same time, one end of the first rocker arm 10 may also be rotatably connected to the rocker arm shaft 205, as shown in FIG. 7. In addition, the connection mechanism 100 (i.e. the cylinder deactivation mechanism in the cylinder deactivation exhaust rocker arm 21) may be disposed in the first rocker arm 10.

The brake exhaust rocker arm 22 of the embodiment of the present application employs a fixed-chain type brake mechanism that transfers the motion of the two-stroke brake cam to the engine exhaust valve (single or double valve), resulting in the brake valve lift shown with the thin dashed line in FIG. 4 including a first compression released valve lift 201, a second compression released valve lift 203, a first EGR valve lift 204 and a second EGR valve lift 202 from different lobes on the same brake cam. The first compression-released exhaust valve lift 201 is similar to that of the four-stroke brake of FIG. 2, near the compression top dead center of the engine (the top dead center of the first compression stroke) starting before the compression top dead center and closing after the compression top dead center. The second compression-released exhaust valve lift 203 is near the exhaust top dead center of the engine (the top dead center of the second compression stroke) starting before the exhaust top dead center and closing after the exhaust top dead center. Since the conventional exhaust valve lift is canceled (cylinder deactivation), the normal (firing) exhaust stroke is converted to a compression stroke during brake, i.e. the second compression stroke during the two-stroke brake. The first EGR valve lift 204 is similar to the EGR lift profile of the four-stroke brake of FIG. 2, near the engine intake bottom dead center (starting before the intake bottom dead center and closing after the intake bottom dead center). The second EGR valve lift 202 is near the expansion bottom dead center of the engine (starting before the expansion bottom dead center and closing after the expansion bottom dead center). The cam lobes that produce the four brake valve lifts described above may be separated or connected end-to-end (for example, between 202 and 203 in FIG. 4, the valves are not seated) and have a height less than the exhaust lobe for the engine firing operation. Note that in the prior art, a cylinder deactivation intake rocker arm is used for the two-stroke engine brake, and the lift 30 by a conventional intake rocker arm 31 of the engine is canceled (cylinder deactivation) during brake. Unlike the prior art, this application uses a conventional intake rocker arm 31 for the two-stroke engine brake, thus preserving the conventional intake valve lift 30 (see the thick solid lines in FIGS. 1, 2 and 4).

The brake intake rocker arm 32 of the embodiment of the present application employs a fixed-chain type brake mechanism to actuate on the conventional intake rocker arm 31, opening the two intake valves of the engine (it is also possible to open only one of the two intake valves) during the engine expansion stroke, and producing the brake intake valve lift 302 as shown by the thick dashed line in FIG. 3, which is also called a second intake valve lift (the intake valve lift produced during the intake stroke is the first intake valve lift) to let in gas for the second compression stroke of the two-stroke brake. The brake intake valve lift 302 starts after the compression top dead center and closes near the expansion bottom dead center. Note that in the prior art, the brake intake rocker arm 32 is required to generate, in addition to the brake intake valve lift 302 (the second intake valve lift), another brake intake valve lift (the first intake valve lift) in the intake stroke to take the place of the conventional intake valve lift 30 eliminated by the cylinder deactivation intake rocker arm.

Figure 8:
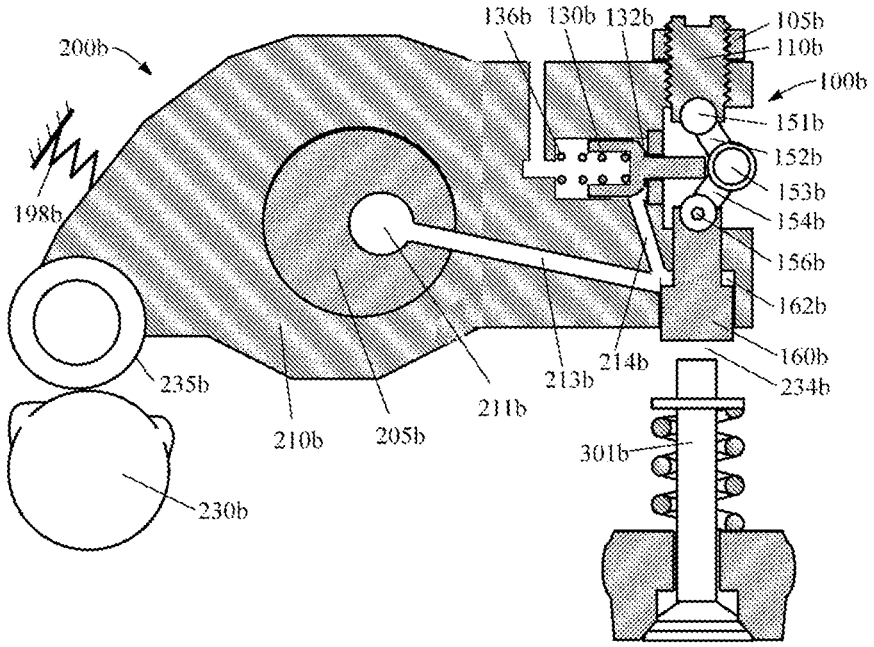
FIG. 8 is a schematic diagram of a specific fixed-chain type brake mechanism in the brake exhaust rocker arm and/or the brake intake rocker arm, wherein the linkage-piston mechanism is in a retracted state according to the present invention.
Figure 9:
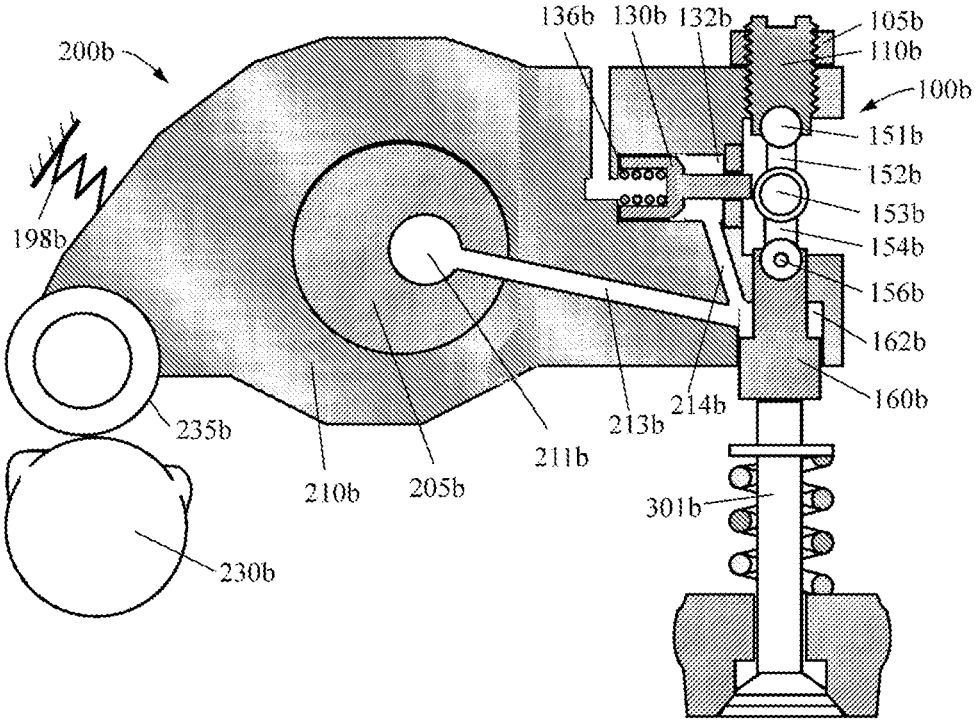
FIG. 9 is a schematic diagram of a specific fixed-chain type brake mechanism in the brake exhaust rocker arm and/or the brake intake rocker arm, wherein the linkage-piston mechanism is in an extended state according to the present invention.

In this embodiment, the brake exhaust rocker arm 22 and/or the brake intake rocker arm 32 use a fixed-chain type brake mechanism, and reference can be made to the following specific structures: FIGS. 8 and 9 are intended to depict one particular configuration of a fixed-chain type brake mechanism used with the brake exhaust rocker arm 22 and/or the brake intake rocker arm 32 of the present invention. The rocker arm device **200*b* in the figure includes a rocker arm 210*b* disposed on a rocker arm shaft 205*b* of the engine, the rocker arm 210*b* having one end near a cam 230*b* of the engine and the other end near a valve 301*b* of the engine. The rocker arm 210*b* is provided with a link piston mechanism 100*b* (i.e., a fixed-chain type brake mechanism adopted by the brake exhaust rocker arm 22 and/or the brake intake rocker arm 32), including a first linkage 152*b*, a second linkage 154*b* and a connecting piston 160*b* (the connecting piston 160*b* is disposed in an actuation piston bore 162*b* provided on the rocker arm 210*b*), one end of the first linkage 152*b* and one end of the second linkage 154*b* are rotatably connected at 153*b*, and the other end of the first linkage 152*b* is rotatably connected to the rocker arm 210*b* at 151*b* (an adjusting screw 110*b* is shown as part of the rocker arm 210*b*, which is fastened by a nut 105*b* on the rocker arm 210*b*), the other end of the second linkage 154*b* is rotatably connected to one end of the connecting piston 160*b* at 156*b*, the other end of the connecting piston 160*b* faces (towards) an engine valve 301*b*, and the extension and contraction between the first linkage 152*b* and the second linkage 154*b* change the gap 234*b* between the connecting piston 160*b* and the engine valve 301*b* as well as the motion transferred to the engine valve 301*b* by the cam 230*b*. A single valve 301*b*** is shown herein, and the present invention is equally applicable to double valves, although a valve bridge may be added.

An angle between the first linkage **152*b* and the second linkage 154*b* of the link piston mechanism 100*b* is greater than 0° and less than or equal to 1800 and the minimum angle can be controlled by a stop mechanism. When the angle is a flat angle (180°), the first linkage 152*b* and the second linkage 154*b* are on the axis of the connecting piston 160*b* (same as the motion direction of the connecting piston 160*b*), the connecting piston 160*b* is fully extended, the clearance between the connecting piston 160*b* and the engine valve 301*b* is minimum, and the motion of the cam 230*b* is maximally transferred to the engine valve 301*b*; as the angle decreases, the connecting piston 160*b* retracts, the clearance between the connecting piston 160*b* and the engine valve 301*b* increases, and the motion transferred to the engine valve 301*b* by the cam 230*b*** is reduced or completely lost.

This embodiment also includes a guide mechanism with a pinned connection at one or more of the rotational joints (**151*b*, 153*b*, and 156*b*), alternatively, the sides of the first and second linkages may be guided in cooperation with a slot in the rocker arm so that the first linkage 152***b*, the second linkage 154*b*, and the connecting piston 160*b* can move in one plane.

This embodiment also includes an anti no-follow spring 198*b* that urges the rocker arm 210*b* toward the cam 230*b* of the engine to prevent an impact between the rocker arm 210*b* and the engine valve 301*b* due to the clearance between them.

This embodiment further includes a preloaded spring 136*b* that reduces the angle between the first linkage 152*b* and the second linkage 154*b* to retract the connecting piston, and specifically includes a spring piston 130*b* mounted in a spring piston bore 132*b* in the rocker arm 210*b*, and the preloaded spring 136*b* reduces the angle between the first linkage 152*b* and the second linkage 154*b* by pushing out the spring piston 130*b*, and in this embodiment, the spring piston 130*b* may be pushed back by oil pressure against the force of the preloaded spring 136*b*.

This embodiment further includes an actuation piston 160*b* which increases the angle between the first linkage 152*b* and the second linkage 154*b* and extends the connecting piston 160*b*, and specifically, in this embodiment, the angle between the first linkage 152*b* and the second linkage 154*b* is increased and the connecting piston extended by pushing the actuation piston (in a piston bore 162*b* in the rocker arm 210*b*) toward the engine valve 301*b* by oil pressure. In this embodiment, the actuation piston 160*b* and the connecting piston 160*b* are one body.

The operation of this embodiment is as follows. In the normal (or default) state, the control valve (not shown) is switched off for oil discharging, oil pressure in the spring piston chamber 132*b* and the actuation piston chamber 162*b* is diminished, the preloaded spring 136*b* pushes the spring piston 130*b* out (to the right), the link piston mechanism 100*b* is pushed to the retracted position as shown in FIG. 8, and the gap 234*b* between the connecting piston 160*b* and the engine valve 301*b* increases, reducing or eliminating the motion transferred to the valve 301*b* by the cam 230*b*.

When the engine needs the cam motion (including the engine brake), the control valve (not shown) is switched on to supply engine oil to the actuation piston bore 162*b* through the oil passage (such as an axial oil hole 211*b* in the rocker arm shaft 205*b* and the oil passages 213*b* and 214*b* in the rocker arm 210*b*), the oil pressure pushes out (downwards) the actuation piston 160*b* (in this embodiment, the connecting piston and the actuation piston are one body), and the link piston mechanism 100*b* in the retracted position in FIG. 8 is pulled to the extended position as shown in FIG. 9; the clearance 234*b* between the connecting piston 160*b* and the engine valve 301*b* is reduced or eliminated and the motion of the cam 230*b* is fully transferred to the valve 300*b*. Of course, it is also possible to supply oil to both the spring piston chamber 132*b* and the actuation piston chamber 162*b* at the same time, the oil pressure overcomes the force of the preloaded spring, pushing the spring piston 130*b* back (to the left in the figure), and at the same time the oil pressure pushes the actuation piston 160*b* (the connecting piston and the actuation piston being one body) out (downwards in the figure). At this time, it is easier to pull the link piston mechanism 100*b* in the retracted position in FIG. 8 to the fully extended position as shown in FIG. 9, the clearance between the connecting piston 160*b* and the engine valve 301*b* is reduced or eliminated, and the motion of the cam 230*b* is fully transferred to the valve 300*b*.

In the above-described embodiment, the rocker arm 210*b* is disposed on the rocker shaft 205*b* of the engine, and as in the present invention, the rocker arm may be disposed at different positions. Meanwhile, it is also possible to adopt a two-piece rocker arm (front and rear rocker arms) structure as shown in FIGS. 5 to 7, in which the link piston mechanism 100*b* is disposed.

Since the present invention preserves the conventional intake rocker arm 31 and the conventional (engine firing) intake valve lift 30, the intake valve opens before the exhaust top dead center and subjects to the braking load (of the second compression-released brake). Therefore, the angle degrees between the starting point of the second compression-released exhaust valve lift 203 and the exhaust top dead center of the engine are larger than the angle degrees between the starting point of the first compression-released exhaust valve lift 201 and the compression top dead center of the engine, thereby reducing the brake cylinder pressure and the load on the intake valve opening.

The above description should not be taken as limiting the scope of the invention, but rather as representing specific illustrations of the invention from which many other variations are possible. For example, the engine brake methods or systems shown herein may be used not only with overhead cam engines, but also with push rod/push tube type engines; it is possible to open not only a single valve but also double valves. Further, the structure, arrangement and disposition of the four rocker arms may also be different, for example, they may be a single rocker arm or a two-piece rocker arm structure, and they may be disposed on different rocker shafts. In addition, instead of using a fixed-chain type rocker arm to drive the engine valve, other driving means such as a hydraulic mechanism may be selected.

Embodiment II

FIGS. 5 and 6 are used to describe Embodiment 2 of the rocker arm mechanism for variable valve actuation of an engine of the present invention.

The rocker arm mechanism in the figures includes a first rocker arm 10, a second rocker arm 210 and a connection mechanism 100 (the cylinder deactivation mechanism in the cylinder deactivation exhaust rocker arm 21), wherein one end of the first rocker arm 10 and one end of the second rocker arm 210 are rotatably connected to a shaft 120, the other end of the first rocker arm 10 is close to the engine valves 300, and the other end of the second rocker arm 210 is close to a cam 230 of the engine. The connection mechanism 100 includes a connecting piston 160 and a linkage mechanism 150 which are both disposed on the second rocker arm 210 (the connecting piston 160 can be disposed in a matched piston bore in the second rocker arm 210), one end of the linkage mechanism 150 is rotatably connected to the second rocker arm 210 at 153, the other end of the linkage mechanism 150 is rotatably connected to one end 162 of the connecting piston 160, and the other end 164 of the connecting piston 160 is close to the first rocker arm 10 that does not have the connecting piston 164. The extension and contraction of the linkage mechanism 150 change the length of the connection mechanism 100 between the first rocker arm 10 and the second rocker arm 210 (see the change in length between 153 and 164 in FIGS. 5 and 6), and the motion of the cam 230 transferred to the valves 300 of the engine is changed. Of course, another embodiment could be adopted in which both the connecting piston 160 and the linkage mechanism 150 are disposed in the first rocker arm 10 with the other end 164 of the connecting piston 160 being adjacent to the second rocker arm 210 that does not have the connecting piston but could have a connecting member).

The linkage mechanism 150 includes a first linkage 152 and a second linkage 154, one end of the first linkage 152 and one end of the second linkage 154 are rotatably connected via a pin 151 (which may also be a spherical surface), the other end of the first linkage 152 is rotatably connected to one end 162 of the connecting piston 160, and the other end of the second linkage 154 is rotatably connected to the second rocker arm 210 (when the connecting piston 160 and the linkage mechanism 150 are both disposed in the first rocker arm 10, then the other end of the second linkage 154 is connected to the first rocker arm 10) via a pin 153 (which may also be a spherical surface); an angle between the first linkage 152 and the second linkage 154 is greater than 0° to less than or equal to 180° (see FIGS. 5&6). When the angle is equal to 180°, the first linkage 152 and the second linkage 154 are on the axis of the connecting piston 160 (the motion direction of the piston 160), and at this time, the connecting piston 160 is locked with the linkage mechanism 150 to the second rocker arm 210 (or the first rocker arm 10) and cannot move relative to each other (see FIG. 6); the length (between 153 and 164) of the connection mechanism 100 between the first rocker arm 10 and the second rocker arm 210 is maximized, and the motion of the cam 230 is maximally (fully) transferred to the valves 300 of the engine; when the actuation piston 130 pushes the linkage mechanism 150 such that the angle is reduced (less than 180°), the linkage mechanism 150 retracts to unlock (see FIG. 5) and the length of the connection mechanism 100 between the first rocker arm 10 and the second rocker arm 210 is reduced (the length between 153 and 164 in FIG. 5 is less than the length in FIG. 6), and the motion of the cam 230 transferred to the valves 300 of the engine is reduced or even completely lost (engine cylinder deactivation).

The connection mechanism 100 further includes a driving spring 156, and with its force the linkage mechanism 150 can be fully extended that the first linkage 152 and the second linkage 154 are aligned with the axis of the connecting piston 160. The preload of the driving spring 156 can even unfold the linkage mechanism 150 when the angle between the first linkage 152 and the second linkage 154 is small to generate a larger stroke (of the connecting piston 160).

It is noted that the driving spring 156 can also prevent no-follow. If desired, however, an anti no-follow spring 198 can be added between the first rocker arm 10 and the second rocker arm 210. The anti no-follow spring 198 urges the second rocker arm 210 toward the cam 230 of the engine. The anti no-follow spring may also be mounted at other locations to help the driving spring 156 to reduce the impact between the first and second rocker arms.

This embodiment provides a stop mechanism at 122 between the first rocker arm 10 and the second rocker arm 210 which limits the first rocker arm 10 and the second rocker arm 210 from rotating too far relative to the shaft 120 to facilitate handling and installation.

This embodiment is implemented as follows: when the engine requires cylinder deactivation (eliminating the normal or conventional valve motion of the engine), the cylinder deactivation control valve (not shown) opens to supply engine oil to the actuation piston 130 via oil passages (such as the axial oil hole 211 in the rocker shaft 205), the oil pressure pushes the actuation piston 130 out (upwards in the figure), the linkage mechanism 150 in FIG. 6 which is fully extended to a flat angle is pushed to the retracted position shown in FIG. 5, the length of the connection mechanism 100 between the second rocker arm 210 and the first rocker arm 10 is reduced (the length between 153 and 164 in FIG. 5 is less than the length in FIG. 6), the motion of the cam 230 driving the second rocker arm 210 is absorbed (lost), the motion of the valve 300 is zero, and the engine cylinder is deactivated. During this process, the driving spring is compressed due to the reduced length described above.

When it is needed to restore the normal or conventional valve motion of the engine, the cylinder deactivation control valve (not shown) disconnects and the engine oil is discharged, the actuation piston 130 loses the oil pressure, the driving spring 156 extends from the compressed state, the linkage mechanism 150 is unfolded from a contracted state (the angle between the first linkage 152 and the second linkage 154 is less than a flat angle in FIG. 5) to a straight status (the angle between the first linkage 152 and the second linkage 154 is a flat angle in FIG. 6), and a lock is formed between the connecting piston 160 and the second rocker arm 210 (or the first rocker arm 10) through the linkage mechanism 150; the connection mechanism 100 has a maximum length (a length between 153 and 164) between the first rocker arm 10 and the second rocker arm 210. The motion of the cam 230 is transferred to the engine valve 300 via the roller 235, the second rocker arm 210, the linkage mechanism 150, the connecting piston 160, the first rocker arm 10 (there may also be a connecting member), an e-foot mechanism 50, and a valve bridge 400 (a valve cap, not shown).

It is noted that the above description applies to the actuation of both the exhaust valve and the intake valve of the engine. At the same time, one end of the first rocker arm 10 may also be rotatably connected to the rocker arm shaft 205, as shown in FIG. 7.

The above description contains many different embodiments, which should not be construed as limiting the scope of the invention, but as representing specific examples of the invention from which many other variations are possible. For example, the engine brake methods or systems shown herein may be used not only with overhead cam engines, but also with push rod/push tube engines; not only a single valve but also double valves can be opened; it can not only be used to drive the exhaust valve, but also to drive the intake valve; the number, size, shape and phase of the lobes of the brake cam may vary.

In addition, the connection mechanism shown here can be not only a piston-spring mechanism, but also other mechanisms, such as hydraulic, pneumatic, electromagnetic, mechanical, etc. and combinations thereof; it can be integrated not only in the rocker arm but also on other parts of the engine. The type, shape, size and mounting position of the connection mechanism, the design of the oil passage, and the structure and arrangement of the flow control valves may vary. The second rocker arm may further include a positioning mechanism of the engine valve bridge, such as a positioning piece fixed to the first rocker arm and connected to the engine valve or the valve bridge above the valves.

Further, the rocker arm mechanism herein may also be used for engine brake when an engine brake device is provided, including a brake rocker arm and a brake cam. The brake rocker arm is disposed alongside a rocker mechanism on a rocker shaft of the engine, the brake rocker arm being in a brake state when a linkage mechanism of the rocker mechanism is in a retracted state, motion of the brake cam being transferred to a valve of the engine to generate engine-braked valve motion.

Further, the types of the brake rocker arm mechanism may be various, and the brake rocker arm may be an integral hydraulic-type dedicated brake rocker arm, a fixed-chain type brake rocker arm, or the like, in addition to the two-piece (first and second rocker arms) rocker arms as in the present application.

The scope of the invention should, therefore, be determined not with reference to the above-described embodiments, but instead should be determined with reference to the appended claims along with their legal equivalents.

The invention claimed is:

1. A rocker arm mechanism for variable valve actuation of an engine, comprising: a first rocker arm, a second rocker arm, a connection mechanism, and an anti no-follow spring, wherein one end of the first rocker arm and one end of the second rocker arm are rotatably connected to a shaft, the other end of the first rocker arm is close to a valve of the engine, the other end of the second rocker arm is close to a cam;

wherein the connection mechanism comprises a connecting piston and a linkage mechanism, the connecting piston being disposed in the first rocker arm or the second rocker arm, wherein the linkage mechanism is rotatably connected to one end of the connecting piston, the other end of the connecting piston is close to the first rocker arm or the second rocker arm in which the connecting piston is not disposed, wherein extension and contraction of the linkage mechanism change the length of the connection mechanism between the first rocker arm and the second rocker arm, and motion from the cam transferred to the engine valve is changed, and wherein the anti no-follow spring urges the first rocker arm toward the engine valve and urging the second rocker arm toward the cam.

2. The rocker arm mechanism according to claim 1, wherein the linkage mechanism comprises a first linkage and a second linkage, one end of the first linkage is rotatably connected to one end of the second linkage, the other end of the first linkage is rotatably connected to the connecting piston, the other end of the second linkage is rotatably connected to the first rocker arm or the second rocker arm, there is an angle between the first linkage and the second linkage which is greater than 0° to less than or equal to 180°, when the angle is 180°, the first linkage and the second linkage are on the axis of the connecting piston, and the linkage mechanism fully extends with a maximum length in the first rocker arm or the second rocker arm, and the motion of the cam is transferred in the maximum extent to the engine valve, and when the angle decreases, the linkage mechanism contracts with a reduced length in the first rocker arm or the second rocker arm and motion of the cam transferred to the engine valve decreases.

3. The rocker arm mechanism according to claim 1, wherein the connection mechanism comprises a driving spring that extends the linkage mechanism.

4. The rocker arm mechanism according to claim 1, wherein the connection mechanism comprises an actuation piston that retracts the linkage mechanism.

5. The rocker arm mechanism according to claim 1, further comprising a stop mechanism limiting the rotation between the first rocker arm and the second rocker arm on a shaft.

6. The rocker arm mechanism according to claim 1, further comprising a positioning mechanism of a valve bridge of the engine, wherein the positioning mechanism of the valve bridge comprises a positioning piece fixed to the first rocker arm and is connected to the engine valve or the valve bridge.

7. An engine brake device, comprising a brake rocker arm and a brake cam, the brake rocker arm is disposed alongside a rocker mechanism on a rocker shaft of an engine, the brake rocker arm being in a braking state when a linkage mechanism of the rocker mechanism is in a retracted state, motion of the brake cam being transferred to a valve of the engine to generate engine-braked valve motion, wherein the rocker arm mechanism is according to claim 1.

8. A two-stroke engine brake system, comprising four rocker arms to actuate engine valves, the four rocker arms includes a cylinder deactivation exhaust rocker arm, a brake exhaust rocker arm, a conventional intake rocker arm and a brake intake rocker arm, wherein during the two-stroke engine brake, utilizing the cylinder deactivation exhaust rocker arm to cancel the exhaust valve lift that is for the engine normal (firing) operation, the engine exhaust stroke being converted to a second compression stroke for the two-stroke engine brake, the cylinder deactivation exhaust rocker arm comprising the rocker arm mechanism according to claim 1;

utilizing the brake exhaust rocker arm to generate an exhaust valve lift for the two-stroke engine brake;

utilizing the conventional intake rocker arm to generate the same intake valve lift in the intake stroke of the engine as when the engine is in the normal (firing) operation to supply gas for the first compression stroke of the two-stroke engine brake, and utilizing the brake intake rocker arm to generate a braking intake valve lift in the expansion stroke of the engine to supply gas for the second compression stroke.

9. The two-stroke engine brake system according to claim 8, wherein the four rocker arms are fixed-chain type mechanisms that transfer motion of a cam to the valves of the engine through a solid linkage.

10. The two-stroke engine brake system according to claim 8, wherein the two-stroke engine brake exhaust valve lift comprises:

a first compression-released exhaust valve lift near the compression top dead center of the engine, and a second compression-released exhaust valve lift near the exhaust top dead center of the engine.

11. The two-stroke engine brake system according to claim 10, wherein the two-stroke engine brake exhaust valve lift further comprises:

a first EGR exhaust valve lift near the intake bottom dead center of the engine, and a second EGR exhaust valve lift near the expansion bottom dead center of the engine.

12. The two-stroke engine brake system according to claim 10, wherein the angle degrees between the starting point of the second compression-released exhaust valve lift and the exhaust top dead center of the engine are greater than the angle degrees between the starting point of the first compression-released exhaust valve lift and the compression top dead center of the engine.

13. The two-stroke engine brake system according to claim 10, wherein the exhaust valve lifts of the first compression released, the second compression released, the first EGR, and the second EGR of the two-stroke engine brake are from different lobes on the same cam, which may be separated or end-to-end, having a height that is less than the conventional exhaust lobe of the engine.

14. The two-stroke engine brake system according to claim 8, wherein the two-stroke brake exhaust valve lift of the engine comes from one of the two exhaust valves of the engine.

15. The two-stroke engine brake system according to claim 8, wherein the engine-brake intake valve lift starts after the compression top dead center of the engine and closes near the expansion bottom dead center of the engine with a lift less than the conventional intake valve lift for the engine firing operation.

16. The two-stroke engine brake system according to claim 8, wherein the engine-brake intake valve lift is generated by the brake intake rocker arm actuating on the conventional intake rocker arm opening the two intake valves of the engine.

* * * * *